United States Patent [19]

Sase et al.

[11] Patent Number: 4,972,393

[45] Date of Patent: Nov. 20, 1990

[54] CALENDAR DISPLAY APPARATUS

[75] Inventors: Masahiro Sase, Fussa; Takeo Muto, Tokyo; Teruho Keida, Koganei, all of Japan

[73] Assignee: Citizen Watch Co., Ltd., Tokyo, Japan

[21] Appl. No.: 479,416

[22] Filed: Feb. 13, 1990

[30] Foreign Application Priority Data

Feb. 14, 1989 [JP] Japan ..... 1-34213
Nov. 21, 1989 [JP] Japan ..... 1-300847

[51] Int. Cl.[5] ..... G04B 19/24
[52] U.S. Cl. ..... 368/28; 368/37
[58] Field of Search ..... 368/28–40

[56] References Cited

U.S. PATENT DOCUMENTS 1,548,772 8/1925 Van Dyke ..... 368/28
1,600,913 9/1926 Van Dyke ..... 368/37
2,603,940 7/1952 Packard ..... 368/37
23,123,091 7/1938 Becker ..... 368/37
3,621,648 11/1971 Takagi ..... 368/37
4,541,725 9/1985 Baumgartner et al. ..... 368/37

*Primary Examiner*—Vit W. Miska
*Attorney, Agent, or Firm*—Koda & Androlia

[57] ABSTRACT

A calendar display apparatus includes a reference signal generator, a calendar data generator, and rotational display members. The reference signal generator generates a reference signal every period of 24 hours. The calendar data generator generates year, month, date, and day data upon reception of the reference signal. The rotational display members are driven by signals from the calendar data generator so as to display a year, a month, a date, and a day. A scale corresponding to the rotational display member for displaying years is constituted by multiple circular scales. Scale marks representing years are sequentially and continuously formed on the multiple circular scales from its inner circumference to outer circumferences.

11 Claims, 13 Drawing Sheets

| Q1 | Q2 | Q3 | |
|---|---|---|---|
| L | L | L | SUNDAY |
| H | L | L | MONDAY |
| L | H | L | TUESDAY |
| H | H | L | WEDNESDAY |
| L | L | H | THURSDAY |
| H | L | H | FRIDAY |
| L | H | H | SATURDAY |

CALENDAR DISPLAY APPARATUS

BACKGROUND OF THE INVENTION

1. FIELD OF THE INVENTION

The present invention relates to an improvement in a calendar display apparatus of a hand display system, and more particularly, to a calendar display apparatus which can display years with excellent readability and has a function of calling a day of the week.

2. DESCRIPTION OF THE PRIOR ART

A calendar display apparatus has been widely used as an additional function of an electronic timepiece. Especially, a digital calendar display apparatus using an optical display unit has been put into practice in a variety of ways as, e.g., a perpetual calendar with a function of correcting the end of a month and a function of calling a day of the week, along with an improvement in functions of ICs.

An analog calendar display apparatus using a hand display unit is disclosed in Swiss Patent No. CH660440 as an electronic timepiece with a calendar. The electronic timepiece includes a mechanism for driving rotational display members, and displays leap years and its subsequent years in units of four years. However, this electronic timepiece does not satisfy demands for an easy-to-use calendar apparatus in terms of functions.

A conventional electronic timepiece with a calendar will be described below.

FIG. 1 is a front view showing an outer appearance of the conventional electronic timepiece with a calendar. FIG. 2 is a block diagram of the electronic timepiece in FIG. 1.

Referring to FIG. 1 reference numeral 201 denotes an electronic timepiece; 202 a hour hand; 203 a minute hand; and **203*a***, a time indicator with hour and minute marks printed on an peripheral portion of a dial.

Reference numeral 204 denotes a year hand; and **204*a***, a year indicator for displaying a leap year, and the first, second, and third years after the leap year with symbols LEAP YEAR, +1 +2 and +3, respectively.

Reference numeral 205 denotes a month hand; and **205*a***, a month indicator for displaying the months on a peripheral portion of the dial.

Reference numeral 206 denotes a date hand; and **206*a*, a date indicator on which marks of 31** days are printed.

Reference numeral 207 denotes a 24-hour hand; and **207*a***, a 24-hour indicator.

Reference numeral 208 denotes a day hand; and **208*a***, a day indicator for displaying the seven days.

Reference numeral 209 denotes a crown which can be pulled and pushed to a zeroth level, a first level, and a second level.

Reference numerals 210 to 213 denote push buttons for setting switches $S_1$ to $S_4$ in an operative state.

In FIG. 1, therefore, the indication contents displayed by the respective hands are 10:09 A.M., Monday, Oct. 7, first year after a leap year.

A circuit arrangement of the conventional electronic timepiece in FIG. 1 will be described below with reference to the block diagram in FIG. 2.

Reference numeral 10 denotes a switch circuit; and 11 to 17, chattering preventing circuits. Reference symbols $R_1$ and $R_2$ denote switches which are closed when the crown 209 is pulled to the first and second levels; $S_1$ to $S_4$, switches which are closed when the push buttons 210 and 211 are depressed; and $S_{24}$, a date switch which is normally open, but is closed once when the 24-hour hand 207 indicates a 24-hour mark.

When the respective switches are closed, signals $P_{R2}$, $P_{R1}$, $P_{S24}$, $P_{S1}$, $P_{S3}$, and $P_{S4}$ are respectively output, as H-level signals, from the chattering preventing circuits 11 to 17. Reference numerals **11*a* and 12*a*** denote inverters for receiving the $P_{R2}$ and $P_{R1}$ and outputting inverted signals $P_{11a}$ and $P_{12a}$ thereof.

Reference numeral 1 denotes a reference frequency oscillator for outputting an oscillation signal $P_{C1}$.

Reference numeral 2 denotes a frequency divider for receiving the oscillation signal $P_{C1}$ and outputting several types of frequency-divided signals $P_{C2}$.

Reference numeral 3 denotes a time signal generator for receiving the signal $P_{11a}$ from the inverter **11*a* of the switch circuit 10** and outputting a known time pulse.

Reference numeral 4 denotes a time hand driver; 5, a motor; and 6, a time gear train/hand. The time hand driver 4 outputs a drive pulse upon reception of the time pulse, and drives the time gear train/hand 6 through the motor 5.

The calendar display apparatus will be described below.

Means for generating calendar data of a date, a month, a year, and a day, which constitutes the calendar display apparatus, are respectively constituted by control signal generating means 20, 50, 70, and 90, date, month, and year position detectors 40, 60, and 80, and date, month, year, and day hand drive units.

Each hand drive unit is designed to advance a corresponding hand by one drive unit thereof in response to one pulse from a corresponding control signal generator. The date hand drive unit comprises a date hand driver 34, a motor 35, and a date gear train/hand 36. Similarly, the month, year, and day hand drive units respectively comprise month, year, and day hand drivers 64, 84, and 104, motors 65, 85, and 105, and date, year, and day gear trains/hands 66, 86, and 106.

Each control signal generating means comprises an advance signal generator for generating a normal drive pulse, and a correction signal generator for generating a correction drive pulse.

The advance signal generator section of the date control signal generating means 20 comprises a date advance signal generator 29, four AND gates 21, 22, 23, and 28, one OR gate 27, and three one-pulse generators 24, 25, and 26.

The input terminals of the AND gate 21 are respectively connected to the output terminals of a 31-day detector 44 and a 30-day (including 29 or 28 days) month detector 63 (both of which will be described later). The AND gate 21 calculates an AND signal of signals from the two detectors 44 and 63 and outputs the calculation result to the one-pulse generator 24.

Similarly, the input terminals of the AND gate 22 are respectively connected to the output terminals of a 30-day detector 43, a February detector 62 and a leap year detector 83 (all of which will be described later). The AND gate 22 calculates an AND signal of detection signals from the three detectors 43, 62 and 83 and outputs the calculation result to the one-pulse generator 25.

The input terminals of the AND gate 23 are respectively connected to the output terminals of a 29-day detector 43, the February detector 62 and a common year detector 82 (all of which will be described later). The AND gate 23 calculates an AND signal of detection signals from the three detectors 43, 62, and 82 and outputs the calculation result to the one-pulse generator 26.

In addition, a 32-Hz signal $P_{c32}$ of the frequency-divided signals $P_{C2}$ from the frequency divider 2 is normally input to the input terminals of the one-pulse generators 24, 25, and 26. Each of the pulse generators 24, 25, and 26 generates one-pulse output signal every time an AND signal is supplied from a corresponding one of the AND gates 21, 22, and 23, and outputs it to an input terminal of the OR gate 27.

The input terminals of the OR gate 27 are respectively connected to the output terminals of the one-pulse generators 24, 25, and 26 and to the output terminal of the chattering preventing circuit 13 of the date switch $S_{24}$. The output terminal of the OR gate 27 is connected to an input terminal of the AND gate 28.

The input terminals of the AND gate 28 are respectively connected to the output terminals of the inverters 11*a* and 12*a* for inverting signals from the switches $R_1$ and $R_2$, and to the output terminal of the OR gate 27.

The input terminals of the date advance signal generator 29 are respectively connected to the output terminals of the frequency divider 2 and the AND gate 28. The output terminal of the generator 29 is connected to the date hand driver 34 and the I terminal of the base-31 counter 41 (to be described later) through an OR gate 33.

The date correction signal generator section of the date control signal generating means 20 comprises an OR gate 30, an AND gate 31 and a date correction signal generator 32. The input terminals of the OR gate 30 are respectively connected to the output terminals of the chattering preventing circuits 11 and 12. The output terminal of the OR gate 30 is connected to one input terminal of the AND gate 31. The other input terminal of the AND gate 31 is connected to the output terminal of the chattering preventing circuit 14 of the switch $S_1$.

The input terminals of the date correction signal generator 32 are respectively connected to the output terminals of the frequency divider 2 and the AND gate 31. The output terminal of the generator 32 is connected to the date hand driver 34 and the I terminal of the base-31 counter 41.

The drive unit of the date hand 206 drives the date hand 206 by an amount corresponding to one day in response to a one-pulse output signal from the date control signal generator 20, as described above.

The date position detector 40 comprises the base-31 counter 41, a 29-day detector 42, the 30-day detector 43, and the 31-day detector 44. The I terminal of the base-31 counter 41 is connected to the output terminal of the OR gate 33 of the date control signal generator 20. The Q terminal of the counter 41 is connected to the respective detectors 42, 43, and 44. The C terminal of the base-31 counter 41 is connected to an AND gate 52 (to be described later). The R terminal of the counter 41 is connected to the output terminal of the chattering preventing circuit 11. The output terminal of the known 29-day detector 42, which generates one pulse every time count data of not less than 29 is received, is connected to an input terminal of the AND gate 23 constituting the date control signal generating means 20. The 30-day and 31-day detectors 43 and 44, which are similar in operation to the 29-day detector 42, are respectively connected to input terminals of the AND gates 22 and 21.

The month control signal generating means 50 will be described below. Similar to the date control signal generating means 20, the month control signal generating means 50 comprises: a month signal generator section constituted by a month advance signal generator 54 and an AND gate 52; a month correction signal generator section constituted by a month correction signal generator 55, an OR gate 51 and an AND gate 53; and an OR gate 56 connected to the output terminals of the two signal generators 54 and 55.

The input terminals of the AND gate 52 of the month advance signal generator section in the month control signal generating means 50 are respectively connected to the output terminals of the inverters 11*a* and 12*a* of the switch circuit 10, and to the C terminal of the base-31 counter 41.

The input terminals of the month advance signal generator 54 are respectively connected to the output terminals of the frequency divider 2 and the AND gate 52. The output terminal of the generator 54 is connected to the month hand driver 64 and the I terminal of a base-12 counter 61 (to be described later) through the OR gate 56.

The input terminals of the OR gate 51 of the month correction signal generator section of the month control signal generating means 50 are respectively connected to the output terminals of the chattering preventing circuits 11 and 12 of the switch circuit 10. The output terminal of the OR gate 51 is connected to one input terminal of the AND gate 53. The other input terminal of the AND gate 53 is connected to the output terminal of the chattering preventing circuit 15 of the switch $S_2$. The output terminal of the AND gate 53 is connected to an input terminal of the month correction signal generator 55.

The input terminals of the month correction signal generator 55 are respectively connected to the output terminals of the frequency divider 2 and the AND gate 53. The output terminal of the generator 55 is connected to the month hand driver 64 and the I terminal of the base-12 counter 61.

The drive unit of the month hand comprises the month hand driver 64, the motor 65, and the month gear train/hand 66. Similar to the date drive operation, the month hand is driven by an amount corresponding to one month in response to a one-pulse output signal from the month control signal generating means 50.

The month position detector 60 comprises the base-12 counter 61, the February detector 62, and the 30-day month detector 63.

The I terminal of the base-12 counter 61 for counting 12 months is connected to the output terminal of the OR gate 56. The Q terminal of the counter 61 is connected to input terminals of the February detector 62 and the 30-day month detector 63. The R and C terminals of the counter 61 are respectively connected to the output terminal of the chattering preventing circuit 11 and an input terminal of an AND gate 72 (to be described later).

The output terminal of the February detector 62 is connected to input terminals of the AND gates 22 and 23. The output terminal of the 30-day month detector 63 is connected to an input terminal of the AND gate 21.

The year control signal generating means 70 will be described below. The generating means 70 comprises: a year advance signal generator section constituted by a year advance signal generator 74 and the AND gate 72; a year correction signal generator section constituted by a year correction signal generator 75, an OR gate 71, and an AND gate 73, and an OR gate 76 connected to the output terminals of the two signal generators 74 and 75.

The input terminals of the AND gate 72 of the year advance signal generator section are respectively connected to the output terminals of the inverters 11*a* and 12*a* of the switch circuit 10, and to the C terminal of the base-12 counter 61.

The input terminals of the year advance signal generator 74 are respectively connected to the output terminals of the frequency divider 2 and the AND gate 72. The output terminal of the generator 74 is connected to the year hand driver 84 and the I terminal of a base-4 counter 81 (to be described later) through the OR gate 76.

The input terminals of the OR gate 71 of the year correction signal generator section are respectively connected to the output terminals of the chattering circuits 11 and 12 of the switch circuit 10. The output terminal of the OR gate 71 is connected to one input terminal of the AND gate 73. The other input terminal of the AND gate 73 is connected to the output terminal of the chattering circuit 16 of the switch $S_3$. The output terminal of the AND gate 73 is connected to an input terminal of the year correction signal generator 75.

The input terminals of the year correction signal generator 75 are respectively connected to the output terminals of the frequency divider 2 and the AND gate 73. The output terminal of the generator 75 is connected to the year hand driver 84 and the I terminal of a base-4 counter 81 (to be described later) through the OR gate 76.

Since the drive unit for the year hand has the same arrangement as that of the drive unit for the month hand, a description thereof will be omitted.

The year position detector 80 comprises the base-4 counter 81 the common year detector 82, and the leap year detector 83. The I terminal of the base-4 counter 81 is connected to the output terminal of the OR gate 76. The Q terminal of the counter 81 is connected to the input terminals of the common and leap year detectors 82 and 83 for receiving count data. The R terminal of the counter 81 is connected to the output terminal of the chattering preventing circuit 11. The output terminal of the common year detector 82 is connected to an input terminal of the AND gate 23. The output terminal of the leap year detector 83 is connected to an input terminal of the AND gate 22.

Similarly, the day control signal generating means 90 comprises a day advance signal generator section and a day correction signal generator section. The day advance signal generator section is constituted by a day advance signal generator 94 and an AND gate 92.

The input terminals of the AND gate 92 are respectively connected to the output terminals of the inverters 11*a* and 12*a* in the switch circuit 10 and of the chattering preventing circuit 13, and receives the signal $P_{S24}$ from the day switch $S_{24}$.

The input terminals of the day advance signal generator 94 are respectively connected to the output terminals of the frequency divider 2 and the AND gate 92. The output terminal of the generator 94 is connected to the day hand driver 104 through an OR gate 96.

The day correction signal generator section of the day control signal generating means 90 is constituted by a day correction signal generator 95, an OR gate 91, and an AND gate 93.

The input terminals of the OR gate 91 are respectively connected to the output terminals of the chattering preventing circuits 11 and 12. The output terminal of the OR gate 91 is connected to one input terminal of the AND gate 93. The other input terminal of the AND gate 93 is connected to the output terminal of the chattering preventing circuit 17 of the switch $S_4$. The output terminal of the AND gate 93 is connected to an input terminal of the day correction signal generator 95. The input terminals of the day correction signal generator 95 are respectively connected to the output terminals of the frequency divider 2 and the AND gate 93. The output terminal of the generator 95 is connected to the input terminal of the day hand driver 104 through the OR gate 96.

Note that frequency-divided signals to be input from the frequency divider 2 to the respective signal generators have frequencies required for these signal generators.

An operation of the conventional electronic timepiece with the calendar having the above-described arrangement will be described below, in which a calendar time display mode at the zeroth level of the crown, a correction mode at the first level of the crown, and an initialization mode at the second level of the crown will be exemplified, respectively.

In the calendar time display mode when the crown is set at the zeroth level, the switches $R_1$ and $R_2$ are open, and the output signals $P_{11a}$ and $P_{12a}$ from the inverters 11*a* and 12*a* of the switch circuit 10 are held at H level. The time signal generator 3, to which the H-level signal $P_{11a}$ is supplied, receives a predetermined frequency from the frequency divider 2 and outputs a time signal, thereby performing a time display using the known means, i.e., the time hand driver 4, .the motor 5, and the time gear train/hand 6. Since the crown 209 is currently set at the zeroth level, the switches $R_1$ and $R_2$ are open. Therefore, the H-level signals $P_{11a}$ and $P_{12a}$ are respectively supplied to the AND gates 28, 52, 72, and 92 of the date, month, year, and day advance signal generator sections so as to hold them ON.

Since the two inputs of each of the OR gates 30, 51 71 and 91 of the date, month, year, and day correction signal generator sections are set at L level by the L-level signals $P_{R1}$ and $P_{R2}$, their outputs are also set at L level. This keeps the AND gates 31, 53, 73, and 93 in an OFF state.

In this state, the 24-hour hand 207 is interlocked with the time gear train 6. When the 24-hour hand 207 indicates 24 hours, the switch $S_{24}$ incorporated in the gear train is closed, the one-pulse date switch signal $P_{S24}$ is output.

When the date switch signal $P_{S24}$ is input to the OR gate 27 of the date control signal generating means 20 and the AND gate 92 of the day control signal generating means 90, a date advance signal is output from the date advance signal generator 29. As a result, the base-31 counter 41 of the date position detector 40 is incremented, and the date hand 206 is advanced by an amount corresponding to one day through the motor 35.

At the same time, a day advance signal is output from the day advance signal generator 94, and the day hand 208 is advanced by an amount corresponding to one day through the day hand driver 104 and the motor 105.

That is, in a normal operation, each of the date hand 206 and the day hand 208 is advanced by an amount corresponding to one day by the date switch signal $P_{S24}$ which is output every 24 hours, thus performing a normal calendar operation.

The above-described electronic timepiece with the calendar employs a means for automatically correcting the end of a month. At the end of a month, each position detector including the date position detector 40 automatically performs a correcting operation by quick advancement corresponding to a day or days which do not exist. This operation will be described below.

Date count data is output from the Q terminal of the base-31 counter 41 of the date position detector 40, and is input to the 29-day, 30-day, and 31-day detectors 42 43, and 44. The detectors 42, 43, and 44 respectively out-put one-pulse signals every time data of not less than 29, 30, and 31 are input. These signals are respectively input to the AND gates 23, 22, and 21. When the count data is switched to "1", a carry signal is supplied from the C terminal of the counter 41 to the AND gate 52 of the month control signal generating means 50.

In the month position detector 60, month count data is supplied from the Q terminal of the base-12 counter 61 to the February detector 62 and the 30-day month detector 63. Upon detection of February or a month with 30 or less days, the detectors 62 and 63 generate signals. The signal from the detector 62 is input to the AND gates 23 and 22 and the signal from the detector 63 is input to the AND gate 21. When the count data is switched to "1", a carry signal is supplied from the C terminal of the counter 61 to the AND gate 72 of the year control signal generating means 70.

In the year position detector 80, when the common and leap year detectors 82 and 83 which receive count data from the base-4 counter 81 detect a common year and a leap year, signals are respectively output from their output terminals. The signal from the common year detector 82 is input to the AND gate 23, and the signal from the leap year detector 83 is input to the AND gate 22.

As described above, when the detection signal from the detectors 62, 63, 82, and 83 are respectively input to the AND gates 21, 22, and 23 of the date advance signal generator section, the AND gate 21 is held in an ON state in a month with 30 or less days, the AND gate 22 is set in an ON state in February of a leap year, and the AND gate 23 is set in an ON state in February of a common year. While the AND gates 21, 22, and 23 are set in an ON state, they permit gating of signals from the 29-day, 30-day, and 31-day detectors 42, 43, and 44 and allow the pulse generators 24, 25, and 26 to receive the gated signals. Upon reception of the detection signals, the pulse generators 24, 25, and 26 respectively output one-pulse signals. The one-pulse signals are then gated through the OR gate 27 and the AND gate 28 in an ON state, and are input to the date advance signal generator 29.

As a result, the date advance signal generator 29 outputs a one-pulse date advance signal so as to advance the date hand 206 by an amount corresponding to one day and to increment the base-31 counter 41 by an amount corresponding to one day. In this manner, at the end of a month, the date hand 206 is advanced by an amount corresponding to one to three days in accordance with the conditions of the respective detectors 42, 43, and 44 of the date position detector 40.

For example, at the end of February in a leap year, the 30-day detector 43 outputs two detection signals to the AND gate 22 until the count data of the base-31 counter 41 becomes "1". Therefore, the date hand 206 is advanced by an amount corresponding to two days.

When the base-31 and base-12 counters 41 and 61 detect that the respective count data are switched to "1", month and year advance signals are respectively output from their C terminals. These signals are gated through the AND gates 52 and 72 which are in an ON state, to advance the month and year hands 205 and 204, respectively.

The operation of the calendar time display mode of the electronic timepiece with the calendar in FIGS. 1 and 2 has been described above, in which the time display operation and the calendar apparatus are interlocked with each other.

The correction mode set when the crown is positioned at the first level will be described below.

When the crown 209 is pulled to the first level, the switch $R_1$ of the switch circuit 10 is closed. In this state, the signal $P_{R1}$ from the chattering preventing circuit 12 is held at H level, whereas the signal $P_{12a}$ from the inverter 12a is held at L level.

As a result, the AND gates 28, 52, 72, and 92 respectively connected to the date, month, year, and day advance signal generators 29, 54, 74, and 94 are set in an OFF state, and the AND gates 31, 53, 73, and 93 respectively connected to the date, month, year, and day correction signal generators 32, 55, 75, and 95 are set in an ON state.

When the switches $S_1$ to $S_4$ are closed by depressing the push buttons 210 to 213 in this state, the corresponding signals $P_{S1}$ to $P_{S4}$ are set at H level. Therefore, the signals $P_{S1}$ to $P_{S4}$ pass through the AND gates 31, 53, 73, and 93 and are input to the correction signal generators 32, 55, 75, and 95, respectively. As a result, the respective correction signal generators output correction signals so as to correct the date, month, year, and day hands 206, 205, 204, and 208. Note that in the calendar correction mode, since the AND gate 28 is in an OFF state, an automatic correcting operation of a day or days which do not exist at the end or ends of the corresponding month or months is not performed.

The calendar initialization mode when the crown is set at the second level will be described below.

When the crown 209 is pulled to the second level, the switch $R_2$ of the switch circuit 10 is closed. In this state, the H-level $P_{R2}$ signal is output from the chattering preventing circuit 11, whereas the L-level signal $P_{11a}$ is output from the inverter 11a.

As a result, an input terminal of the time signal generator 3 is set at L level, and the generator 3 is set in an OFF state. Hence, the hour and minute hands 202 and 203 as the time hands are stopped. In this state, correction of the time hands can be performed by a known method of mechanically rotating the crown.

The H-level signal $P_{R2}$ is supplied to the reset terminals R of the base-31, base-12, and base-4 counters 41, 61, and 81 so as to reset them. As a result, the contents of the counters 41, 61, and 81 are set at predetermined specific year, month, and date. For example, the contents of the base-4 counter are set to be those of a leap year; the contents of the base-12 counter 61, those of January; and the contents of the base-31 counter 41, those of a first day. In this case, the specific date is set as Jan. 1 of a leap year.

The L-level signal $P_{11a}$ output from the chattering preventing circuit 11 holds all the AND gates 28, 52, 72, and 92 connected to the date, month, year, and day advance signal generators 29, 54, 74, and 94 in an OFF state.

The H-level signal $P_{R2}$ passes through the OR gates 32, 55, 75, and 95 connected to the date, month, year, and day correction signal generators 32, 55, 75, and 95 so as to hold all the AND gates 31, 53, 73, and 93 in an ON state.

When the switches $S_1$ to $S_4$ are closed in this state by depressing the push buttons 210 to 213 in the same manner as in the correction mode, the position of the year hand 204 can be corrected to that of a leap year which is indicated by the contents of the base-4 counter 81.

Similarly, the position of the month hand 205 is corrected to that of January indicated by the contents of the base-12 counter 61; and the position of the date hand 206, to that of the first day indicated by the contents of the base-31 counter 41. In addition, the position of the day hand 208 is corrected to match the specific day. With this operation, initialization of the calendar is completed. Upon this initialization, the year, month, date, and day hands 204, 205, 206, and 208 as display members respectively coincide with the contents of the base-4, base-12 and base-31 counters 81, 61, and 41. By subsequently performing a synchronous operation, an automatic correcting operation of the end of a month of the calendar can be performed.

As described above, in the conventional electronic timepiece with the calendar, the crown 209 is pulled to the second level in the first place so as to mechanically set the time hands, and at the same time, the push buttons 210 to 213 are operated to perform initialization of the calendar.

In addition, the crown 209 is depressed to the first level, and the push buttons 210 to 213 are operated in this state so as to set the calendar to a current date. Thereafter, the crown 209 is depressed to the zeroth level so as to restore the calendar time display mode, thus performing the above-described automatic correction operation of the end of a month.

The conventional electronic timepiece with the calendar of the hand display system displays a year on the basis of a display scheme in which only a leap year and the number of years thereafter can be identified. Therefore, this conventional timepiece can be satisfactorily used as long as initialization of a simple perpetual calendar (automatic correction system for the end of a month) is to be performed. However, in order to realize a so-called day call calendar, as is employed by the above-described digital calendar, in which an year, a month, and a date are designated, and a corresponding day of a week is called, a year number display scheme is required instead of the simple year display scheme in which leap and common years are only identified.

It is not difficult to consider that a year number display scheme is employed in a calendar apparatus of a hand display system as in a digital calendar apparatus. However, if this year number display is to be formed on one circumference as in the display scheme in which a leap year and common years are identified, the number of years which can be identified is limited to about 50. If the number of scale marks formed on one circumference exceeds this limit, the intervals of the marks becomes too small to identify year numbers. However, a calendar of about 50 years is not sufficient for a timepiece with a calendar to increase its commercial value. Similar to a calendar in a digital timepiece, demands have arisen for a day call calendar having a length of about 200 years.

As described above, in the conventional hand display type calendar apparatus, a display portion having a length of about 200 years with satisfactory readability is difficult to form. This interferes with the realization of a day call calendar.

SUMMARY OF THE INVENTION

It is an object of the present invention to solve the above-described problems, provide a display portion having a length of about 200 years with satisfactory readability, and realize a day call calendar using the year display portion.

In order to achieve the above object, according to the present invention, a scale corresponding to a rotational display member for displaying years is constituted by multiple circular scales formed into multiple circles, and scale marks representing years are sequentially and continuously formed on the multiple circular scales from an inner circumference to outer circumferences thereof.

According to another aspect of the present invention, the multiple circular scales corresponding to the rotational display member for displaying years concentrically formed.

According to still another aspect of the present invention, the multiple circular scales corresponding to the rotational display member for displaying years are spirally formed.

According to still another aspect of the present invention, a turn member is arranged to display which circular scale of the multiple circular scales the rotational display member for displaying years indicates.

According to still another object of the present invention, the multiple circular scales are formed such that the number of years represented by scale marks corresponding to one revolution is set to be ($28 \times n$) (n is a positive integer).

DETAILED DESCRIPTION OF THE PREFERRED EMBODIMENTS

The principle of a calendar system of the present invention will be described below with reference to FIG. 3.

In the currently used calendar, i.e., the Gregorian calendar, leap and common years are determined on the basis of the following rule: "Years (A.D.) which are divisible by 4 are leap years. Of the years which are divisible by 4, however, years whose quotients obtained by dividing them by 100 cannot be divided by 4 are common years." According to this rule set in the Gregorian calendar, the years 1900 and 2100 can be presented as examples of years which are not set to be leap years in spite of the fact that they are divisible by 4 and hence appear at the fundamental leap year cycle are common years due to the condition that years whose quotients obtained by dividing them by 100 cannot be divided by 4.

In the years between the special years 1900 and 2100, therefore, leap years regularly come every 4 years except for the special years.

According to the Gregorian calendar, calendars of different years having a common day of Jan. 1 and a common day of March 1 are identical regardless of leap and common years.

If, therefore, the days of Jan. 1 and of March 1 are plotted as representative values of calendars, identity of the calendars can be determined. In this case, identity of calendars means that the calendars have common days of all the months and dates regardless of leap and common years.

Figure 2:
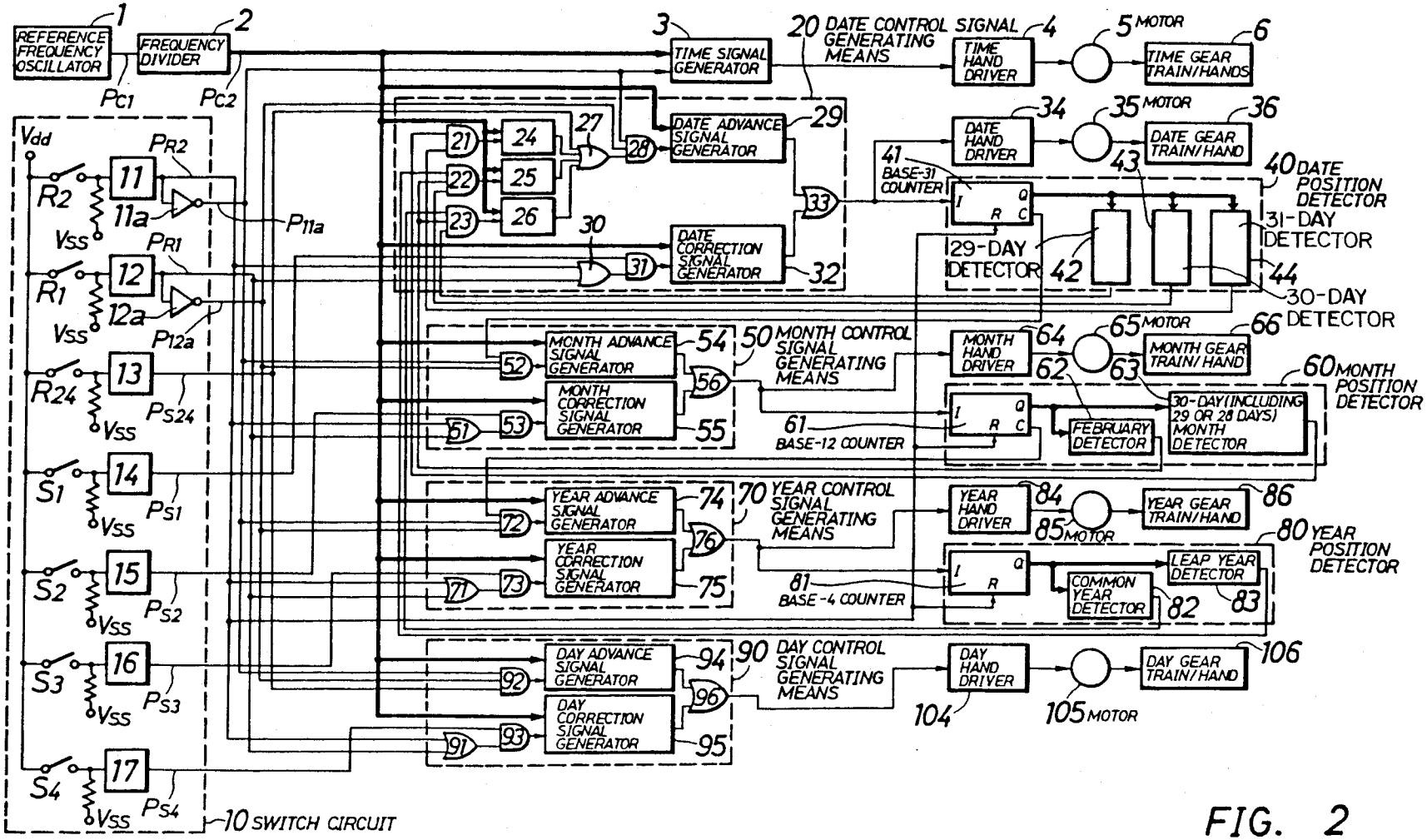
FIG. 2 is a block diagram of the calendar display apparatus of the electronic timepiece in FIG. 1.
Figures 1, 2:
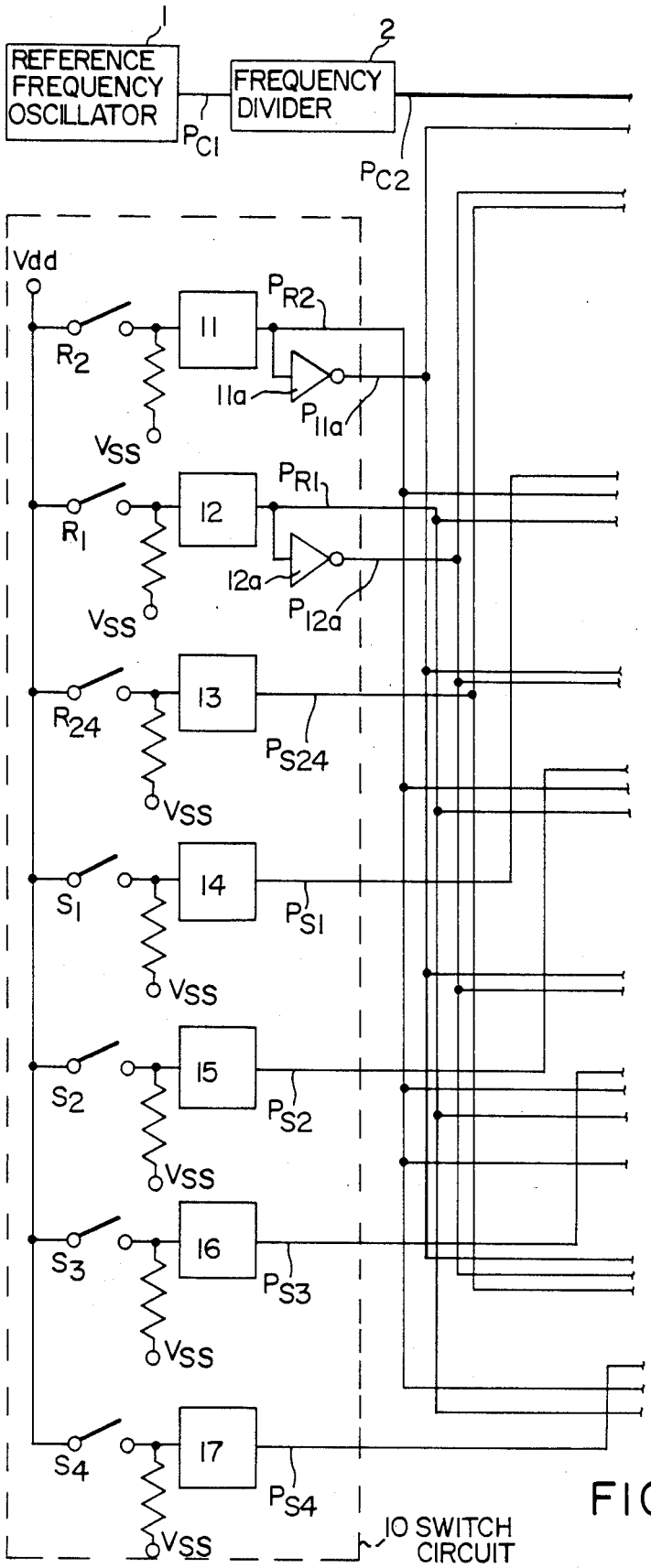
Figure 2:
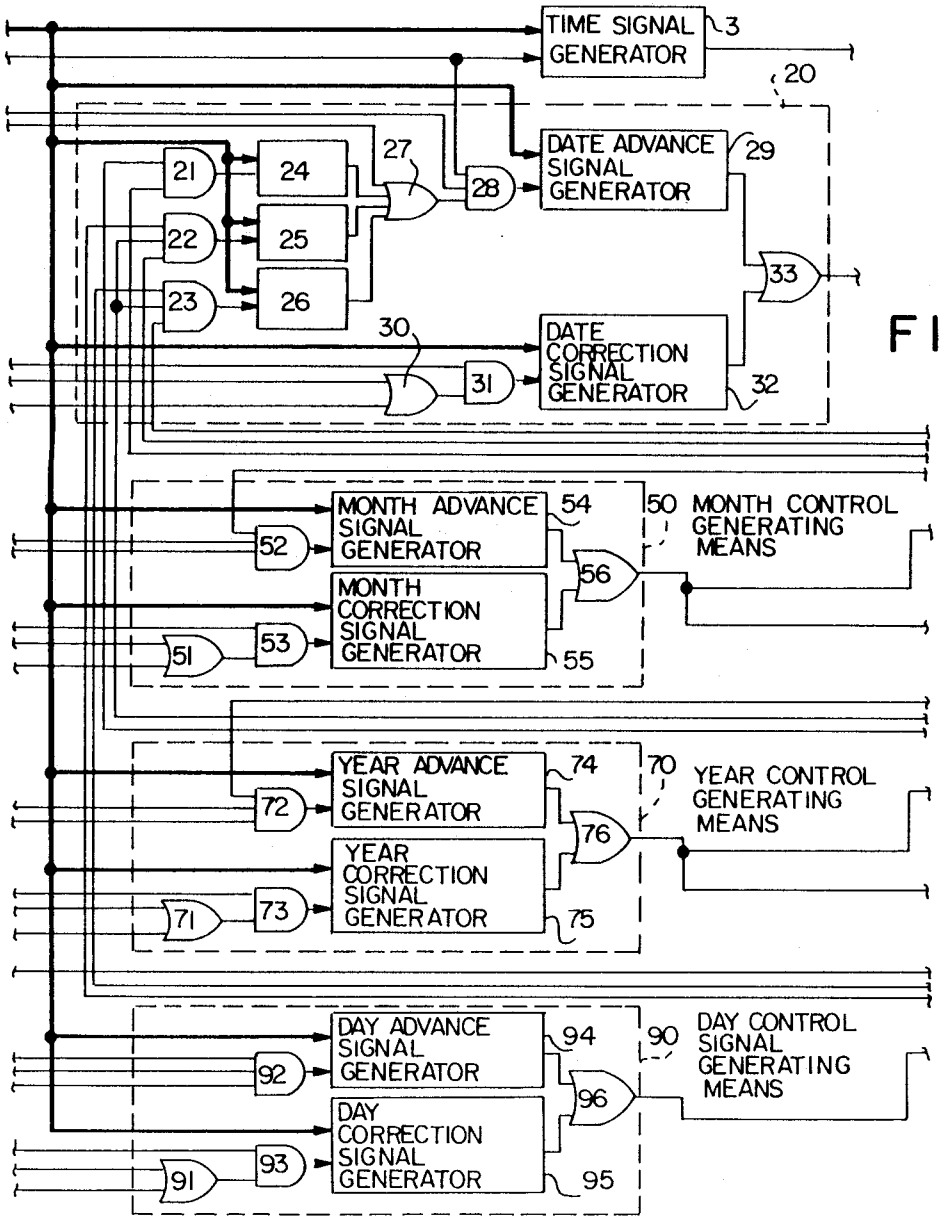
Figures 2, 3:
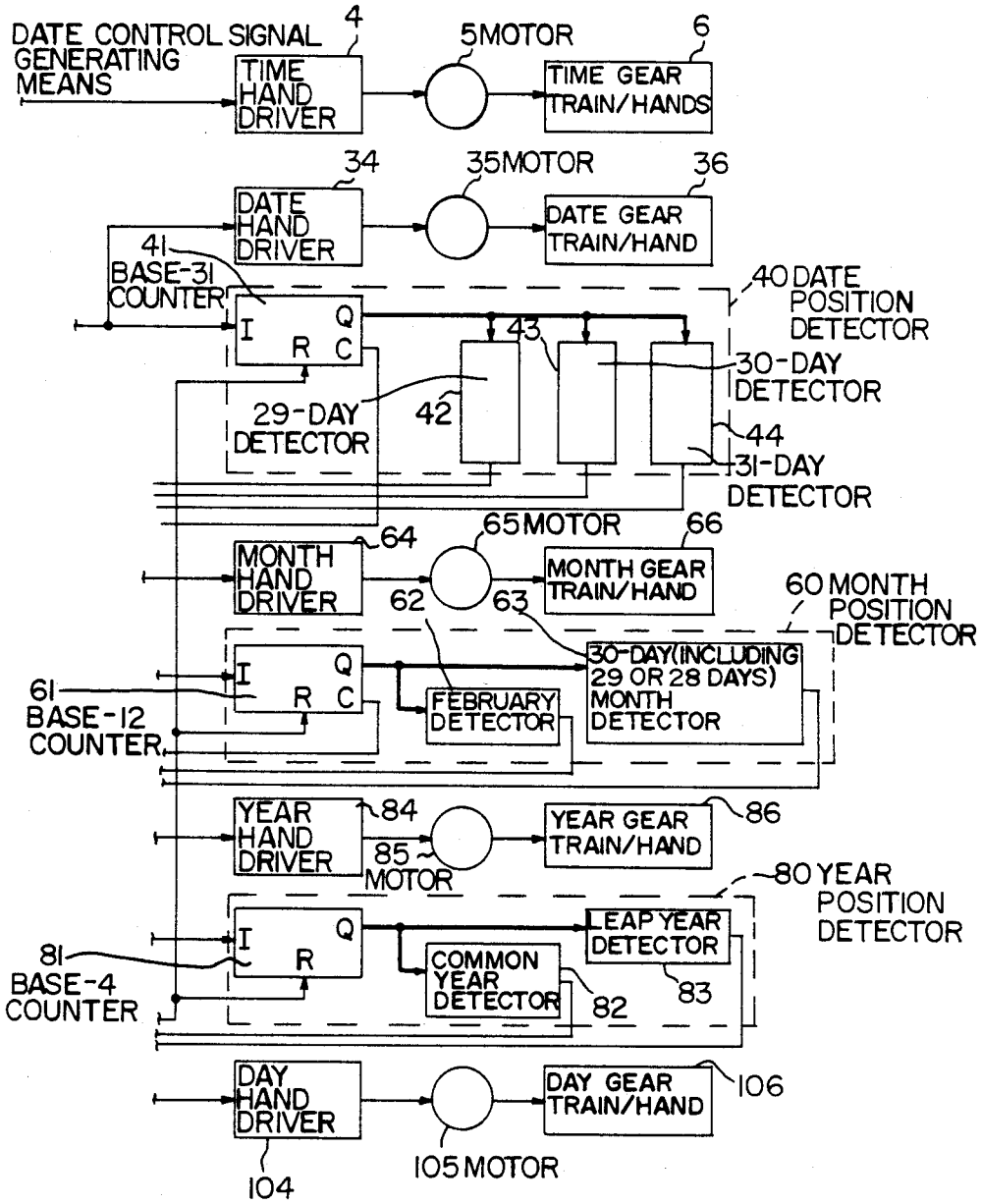
FIG. 3 is a graph showing a calendar repetition cycle.

FIG. 3 is a graph showing a calendar repetition cycle. Referring to FIG. 3, year numbers (A.D.) are sequentially written along the abscissa; and the seven days, along the ordinate. The day of each Jan. 1 is plotted with symbol ○ (in leap years, with symbol ◯, and the day of each March 1 is plotted with symbol X.

The left end of an arrow representing a cycle of 28 years in FIG. 3 indicates the year 2001 in which Jan. 1 corresponds to Monday and March 1 corresponds to Thursday. Similarly, the right end of the arrow indicates the year 2029 in which Jan. 1 corresponds to Monday, and March 1 corresponds to Thursday. Accordingly, one calendar cycle is 28 years as long as leap years comes every 4 years. Theoretically, the least common multiple of "4" (leap years come every 4 years) and "7" (the week consists of seven days), i.e., "28" is set to be one calendar cycle.

That is, 200 years between the year 1901 and the year 2099 on the order of years or between March 1, 1900 and Feb. 28, 2100 on the order of days is the longest interval in which identical calendars regularly appear in a cycle of 28 years. This is the principle of the Gregorian calendar.

In the present invention, in order to expand the year display range, multiple circular scales are employed as a fundamental arrangement. If, for example, the multiple circular scales are constituted by four circular scales, and the scale marks on one circumference correspond to 50 years, a year display of 200 years can be performed with a scale mark size allowing satisfactory identification.

If, however, the scale of a year display portion is constituted by multiple circular scales and the scale marks on one circumference are simply formed to correspond to 50 years, one year hand will simultaneously indicate four year numbers, thus posing a problem in terms of readability. Especially, in a day call calendar, when a year is to be designated, the number of revolutions of the year hand must be remembered. Otherwise, a user cannot know a correspondence between a currently called day and one of the four year numbers on the multiple circular scales indicated by the year hand.

In the present invention, in order to solve the above-described problem, a method based on the rule of the Gregorian calendar in which identical calendars appear in a cycle of 28 years. In this method, the scale marks on one circumference of multiple circular scales are set to correspond to $28 \times n$ so that all the year numbers indicated by the year hand can be included in identical calendars. With this arrangement, when a year is to be designated in a day call calendar, a user need not remember the number of revolution of the year hand but only need set the year hand on the scale mark of a year number to be designated.

Figure 4:
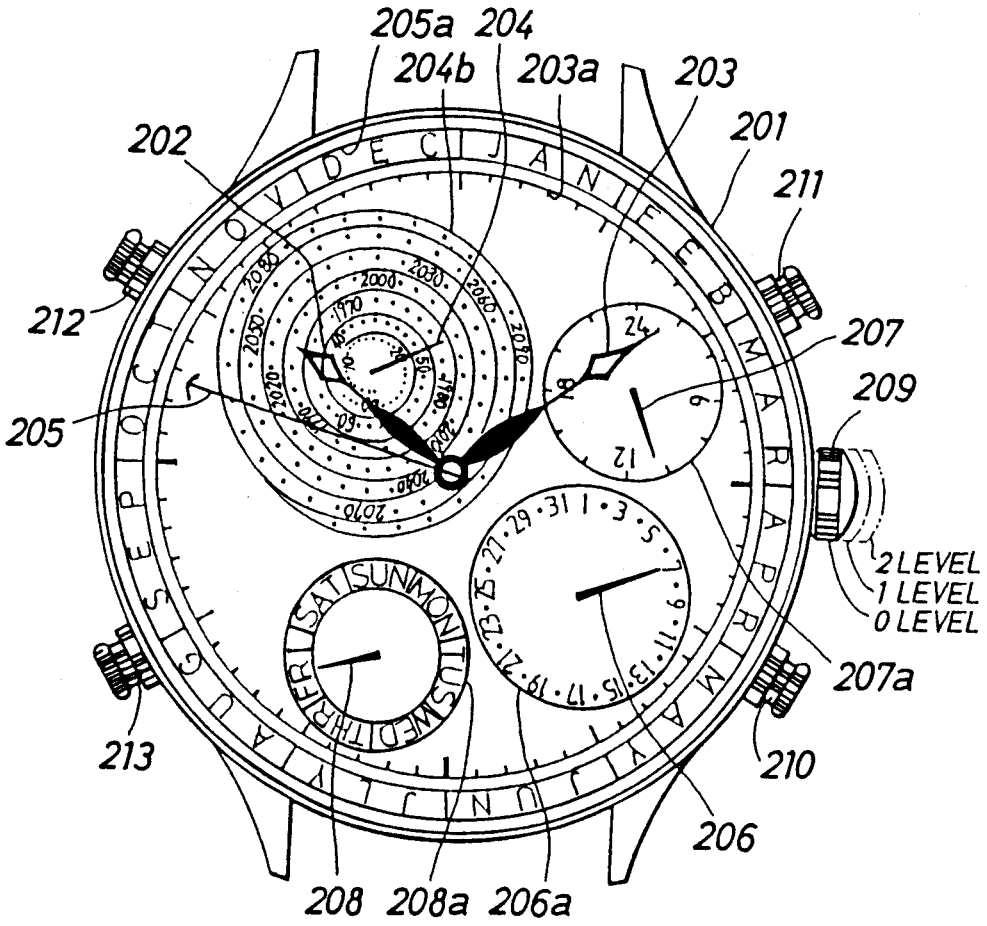
FIG. 4 is a front view showing an electronic timepiece having a calendar display apparatus according to an embodiment of the present invention.

FIG. 4 is a front view showing an outer appearance of an electronic timepiece having a calendar display apparatus according to an embodiment of the present invention.

Figure 5:
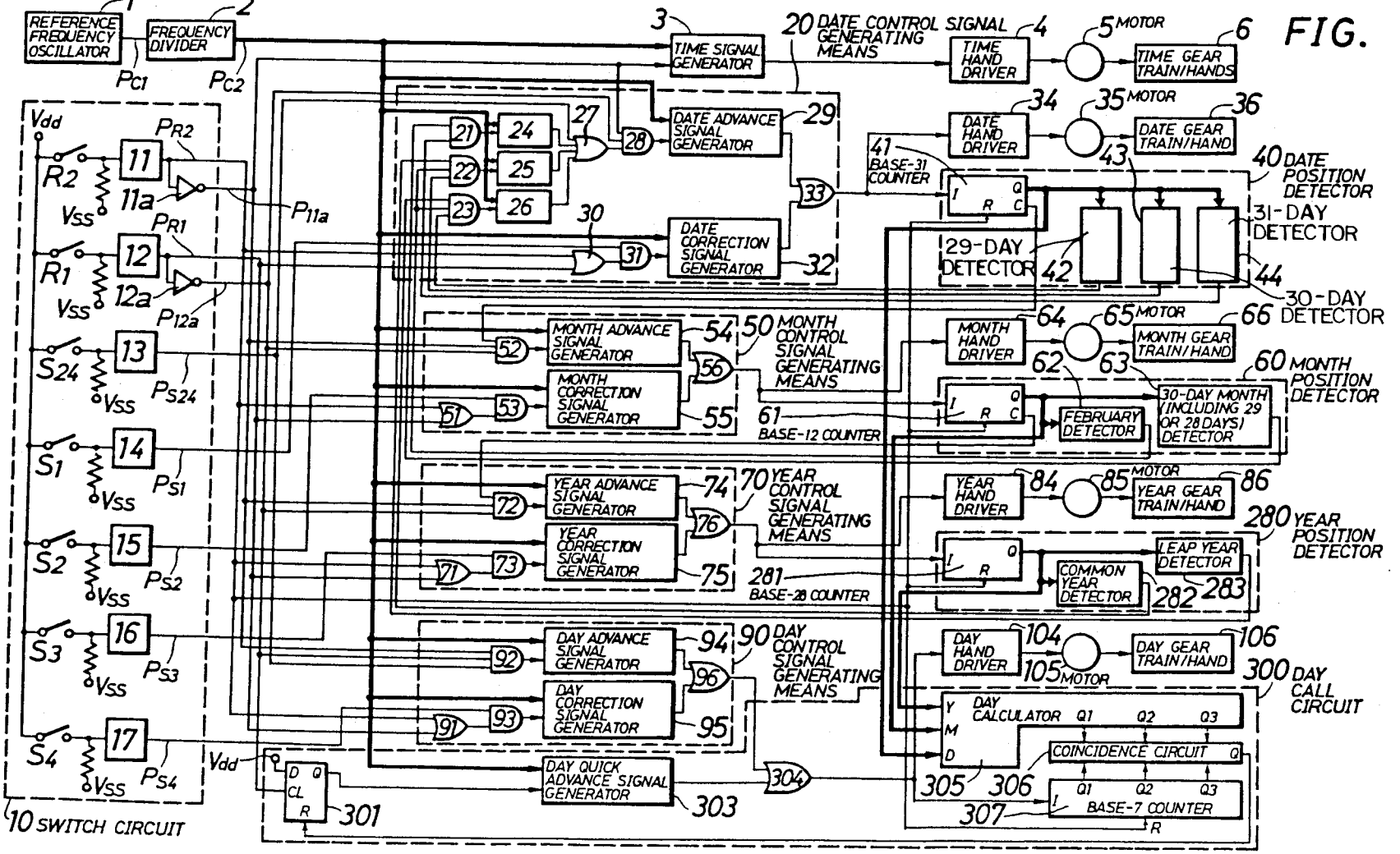
FIG. 5 is a block diagram of the calendar display apparatus of the electronic timepiece in FIG. 4.
Figures 1, 5:
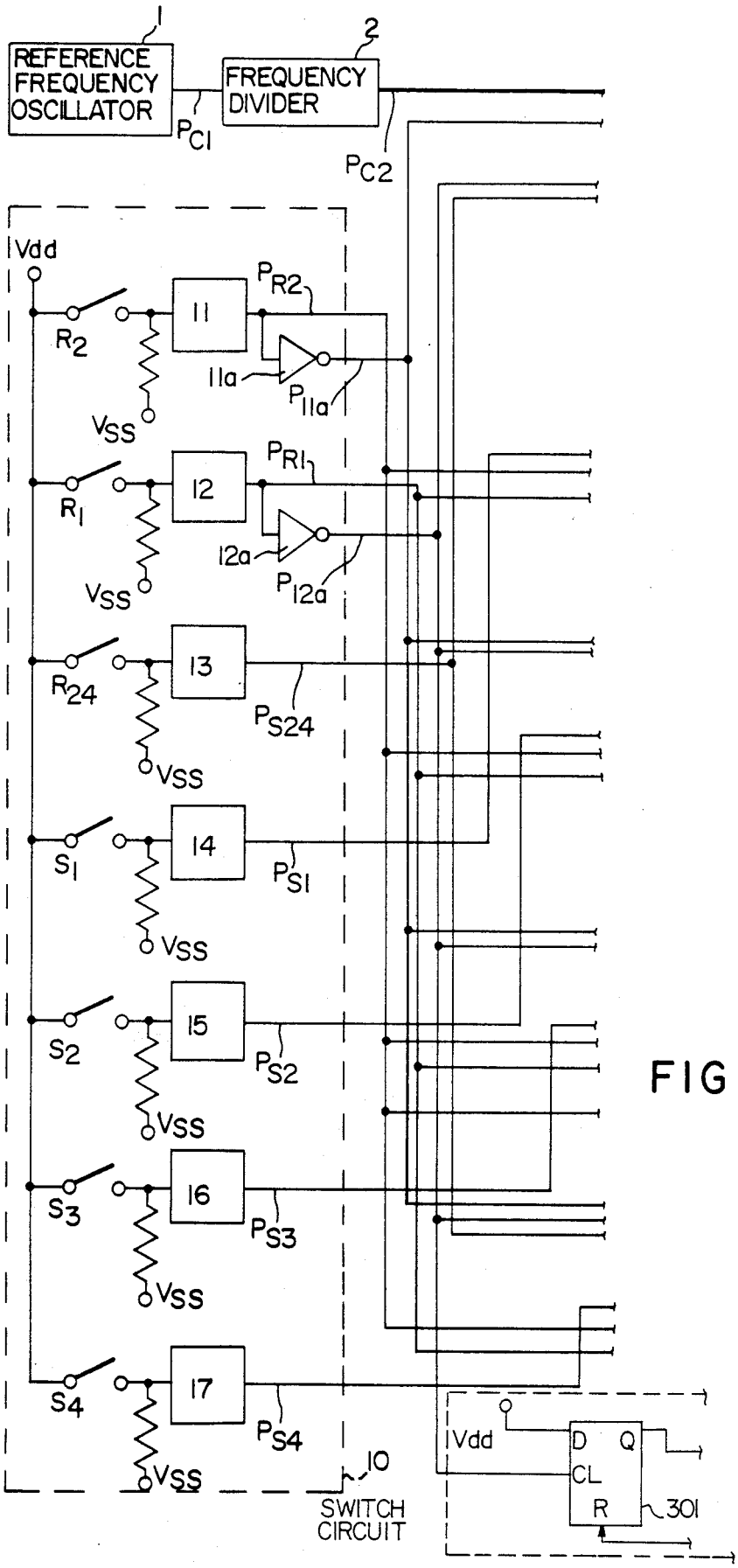
Figures 2, 5:
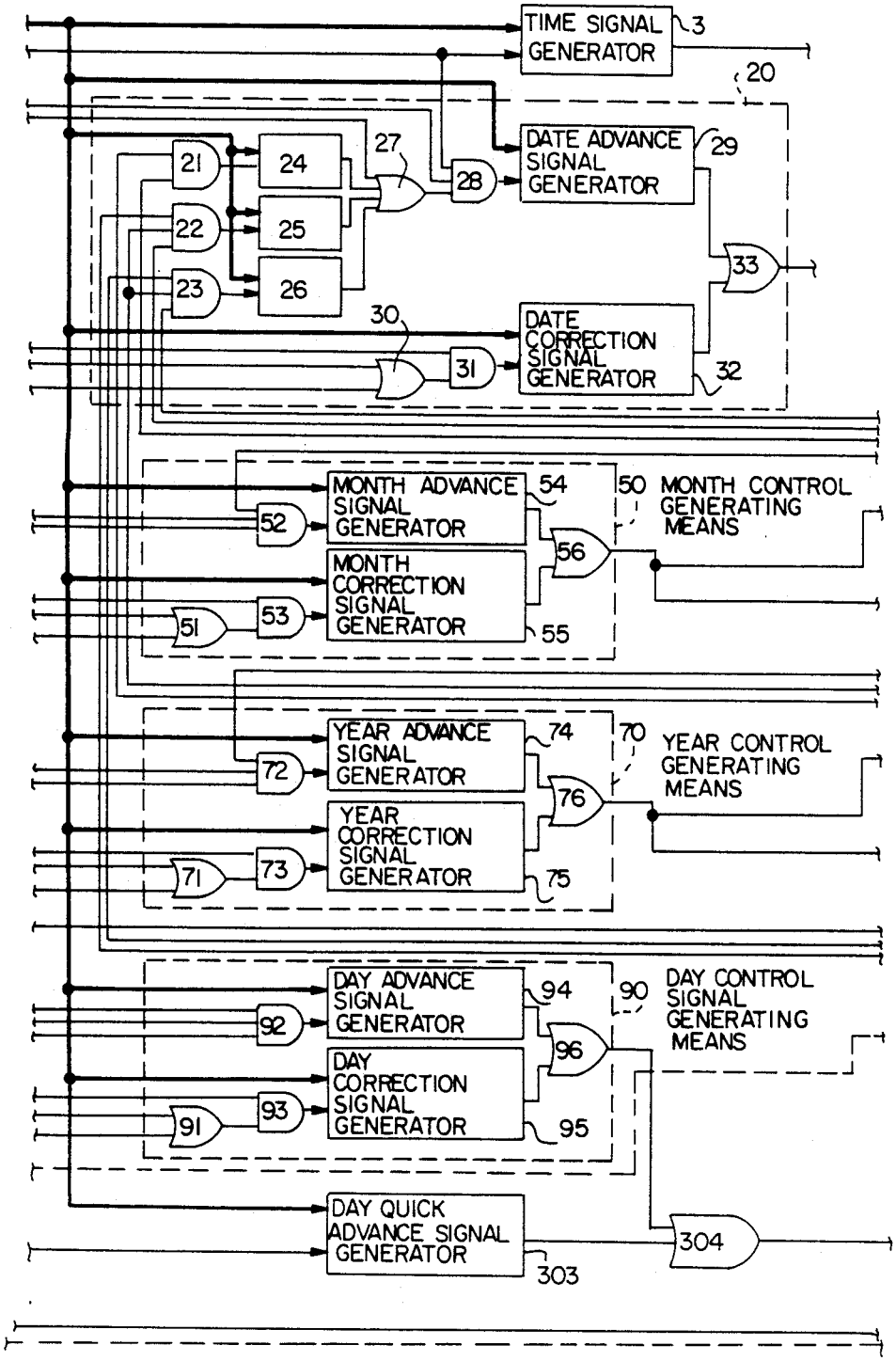
Figures 3, 5:
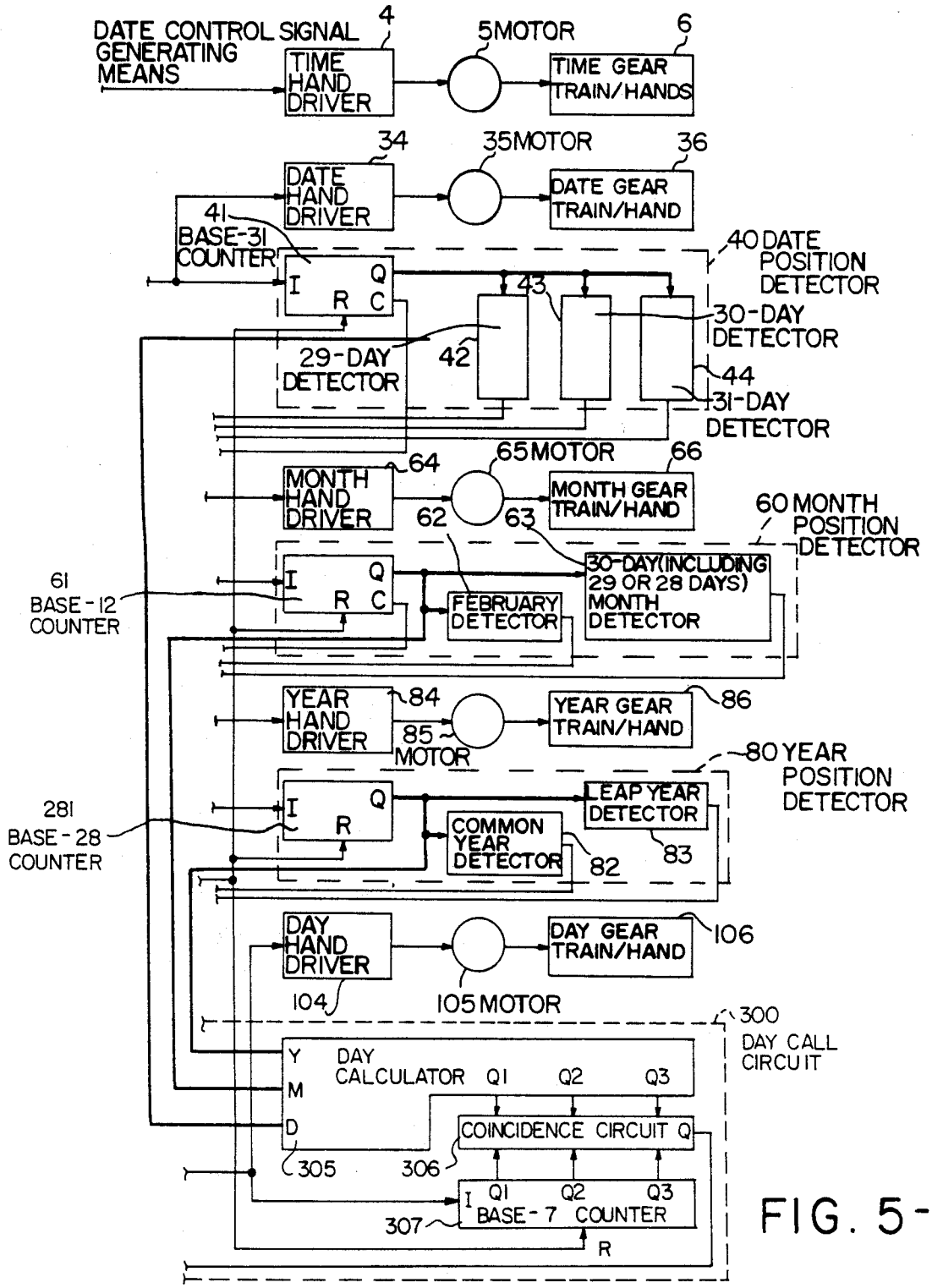

FIG. 5 is a block diagram of the calendar display apparatus of the electronic timepiece in FIG. 4. The arrangements shown in both the drawings are obtained by adding and modifying parts in the arrangements shown in FIGS. 1 and 2. The same reference numerals in FIGS. 4 and 5 denote the same parts as in FIGS. 1 and 2 and a description of common arrangements and operations will be omitted.

Referring to FIG. 4, reference numeral **204*b* denotes a year indicator; and 204, a year hand. The year indicator 204*b* constitutes multiple circular scales in a spiral form, in which numbers and dots which are successively formed in the spiral form represent year numbers (A.D.) The respective dots are arranged on the radii which extend from the rotational center of the year hand as the center and divide an angle of 360° by 28. The scale marks on one circumference correspond to 28 years. On the line indicated by the year hand 204 in the upper direction in FIG. 4**, the number 2000 representing the year 2000 and six dots are displayed.

The dot above the number 2000, therefore, represents the year 2028, and the dot below the number 2000 represents the year 1972. These year numbers belong to identical calendars according to the rule of the Gregorian calendar. The year indicator **204*b* is designed such that the dots of a cycle of 28 years are continuously formed in a spiral form so as to constitute successive scale marks indicating years. The inner start dot of the indicator 204*b*** indicates the year 1901; and the outer end dot, the year 2099.

Figure 1:
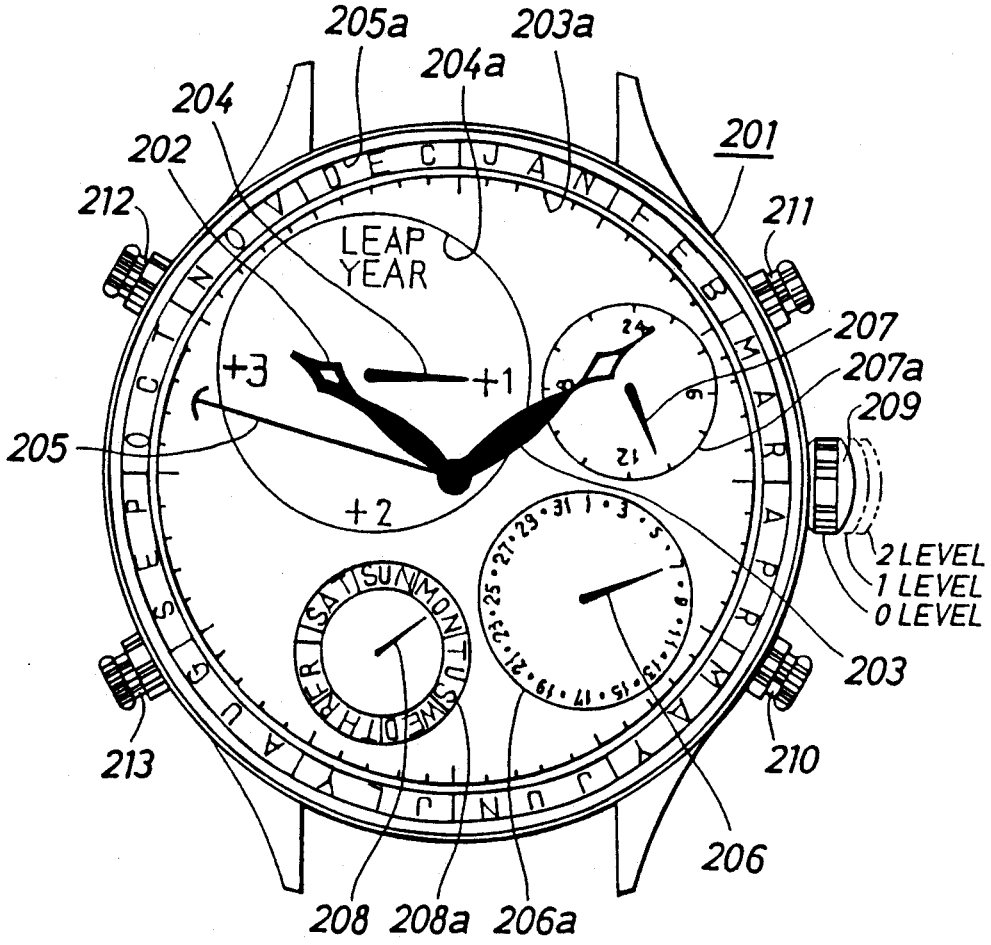
FIG. 1 is a front view showing an electronic timepiece having a conventional calendar display apparatus.

Since other indicators are identical to those of the conventional apparatus shown in FIG. 1, a description thereof will be omitted. The calendar time shown in FIG. 4 is 10:09 A.M., Fri., Oct. 7, 1977. Oct. 7 of all the year numbers indicated by the year hand 204, i.e., the years 1949, 2005, 2033, 2061, and 2089 corresponds to Friday, which is the day of Oct. 7, 1977.

FIG. 5 is a block diagram of the calendar display apparatus of the electronic timepiece in FIG. 4. FIG. 5 shows an arrangement obtained by partially modifying the arrangement shown in FIG. 2 and adding a day call circuit.

More specifically, in the arrangement shown in FIG. 5, the year position detector 80 having the base-4 counter 81 is replaced with a year position detector 280 having a base-28 counter 281, and a day call circuit 300 is added so that data from the counters 41, 61, and 281 are input to the day call circuit 300.

Referring to FIG. 5, reference numeral 280 denotes a year position detector; 281, a base-28 counter; 282, a common year detector; and 283, a leap year detector.

The I terminal of the base-28 counter 281 is connected to the output terminal of an OR gate 76 of a year control signal generating means 7 which is identical to the one of the conventional apparatuses. The Q terminal of the counter 281 is connected to the common year detector 282, the leap year detector 283, and the Y terminal of a day calculator 305 (to be described later).

The Q terminals of the base-31 counter 41 in a date position detector 40 and of the base-12 counter 61 in a month position detector 60 are respectively connected to the D and M terminals of the day calculator 305 so as to output date and month count data.

The day call circuit 300 comprises the day calculator 305, a coincidence circuit 306, a base-7 counter 307, an output inhibiting circuit 301, a day advance signal generator 303, and an OR gate 304.

Figures 3, 6:
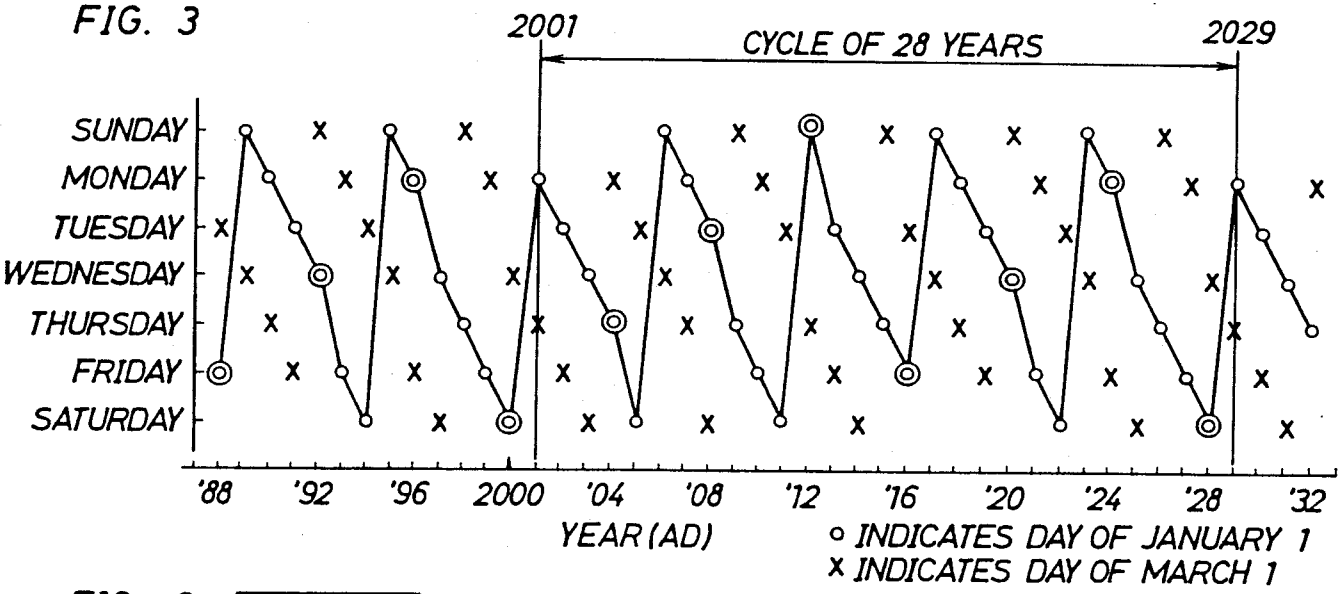
FIG. 6 is a table showing days calculated by a day calculator of the electronic timepiece and output contents from $Q_1$, $Q_2$, and $Q_3$ terminals.

As disclosed in Japanese Unexamined Patent Publication (Kokai) Nos. 54-141171 and 54-104875, the day calculator 305 is a circuit for calculating a day from year, month, and date data. More specifically, the day calculator 305 receives year, month, and date data from the base-28, base-12, and base-31 counters through the Y, M, and D terminals, and calculates a day corresponding to the received year, month, and date data. This calculation value is output, as a base-7 signal representing a day, from the $Q_1$, $Q_2$, and $Q_3$ terminals to the coincidence circuit 306, as shown in FIG. 6.

Upon detection of a coincidence between output values $Q_1$, $Q_2$, and $Q_3$ from the base-$_7$ counter 307 and calculation values $Q_1$, $Q_2$, and $Q_3$ from the day calculator 305, the coincidence circuit 306 holds an output from its Q terminal at H level.

The output inhibiting circuit 301 is a D type flop-flop. The D terminal of the circuit 301 is connected to a power source Vdd. The CL terminal is connected to the output terminal of an inverter 12*a*. The R terminal is connected to the Q terminal of the coincidence circuit 306. The Q terminal is connected to one input terminal of the day advance signal generator 303. A frequency-divided signal $P_{C2}$ having a predetermined period is normally input to the other input terminal of the generator 303.

The two input terminals of the OR gate 304 are respectively connected to the output terminal of the day advance signal generator 303 and the output terminal of an OR gate 96 of a day control signal generating means 90. The output terminal of the OR gate 304 is connected to a day driver 104 and the I terminal of the base-7 counter 307.

The base-7 counter 307 counts the number of pulses input to the I terminal, and outputs the count data to the coincidence circuit 306 through the $Q_1$, $Q_2$, and $Q_3$ terminals. The R terminal of the counter 307 is connected to the output terminal of a chattering preventing circuit 11 to receive a signal $P_{R2}$.

The arrangement of this embodiment which is different from that of the conventional apparatus shown in FIG. 2 has been described above. An operation of the arrangement of the embodiment will be described below.

As described above, in the normal time calendar mode, since year, month, and date data which are respectively supplied from the counters 281, 61, and 41 to the Y, M, and D terminals of the day calculator 305 always coincide with day data from the base-7 counter 307, data from the $Q_1$ to $Q_3$ output terminals based on a value calculated by the day calculator 305 always coincide with data from the $Q_1$ to $Q_3$ output terminals of the base-7 counter 307. As a result, an output from the Q terminal of the coincidence circuit 306 is held at H level to reset the output inhibiting circuit 301.

As a result, the Q terminal of the output inhibiting circuit 301 is held at L level to inhibit output of a day advance signal from the day advance signal generator 303.

In this time calendar display mode, a date switch signal $P_{S24}$ is output once a day upon operation of a date switch $S_{24}$ and is supplied to a date advance signal generator 29 and the day advance signal generator 94.

When the date advance signal output from the date advance signal generator 29 is input to the base-31 counter 41, a series of calendar advance operations are performed, as described with reference to the conventional apparatus in FIG. 2. As a result, the data at the Y, M, and D terminals of the day calculator 305 are changed.

Since the date advance signal is simultaneously input to the day advance signal generator 94, the data of the base-7 counter 307 which receives the day advance signal output from the day advance signal generator 94 is synchronously changed. As a result, the condition of coincidence between the $Q_1$ to $Q_3$ output terminals of the day calculator 305 and those of the base-7 counter 307 is normally held.

In the time calendar display mode, therefore, the Q terminal of the output inhibiting circuit 301 is held at L level, so that the day advance signal generator 303 is inhibited from outputting a day advance signal.

The normal time calendar display mode has been described above. An initialization mode will be described below.

Similar to the conventional apparatus shown in FIG. 2, when a switch circuit 10 is closed by pulling a crown 209 to the second level, the H-level signal $P_{R2}$ is output to the reset terminals R of the base-31 counter 41, the base-12 counter 61, the base-28 counter 281, and the base-7 counter 307.

Consequently, the respective counters are set to predetermined specific year, month, date, and day. In this embodiment, since the specific date is set to be Sunday, Jan. 1, 2000, the contents of the base-28 counter 281 are set to the year 2000; the contents of the base-12 counter 61, to January; the contents of the base-31 counter 41, to the first day; and the contents of the base-7 counter, to Sunday.

When push buttons 210 to 213 are operated in this state, a year hand 204, a month hand 205, a date hand 206, and a day hand 208 can be corrected to coincide with the contents of the counters 281, 61, 41, and 307 in the same manner as in the conventional apparatus. After the calendar hands are set to coincide with the contents of the counters, and hour and minute hands 202 and 203 are corrected by rotating the crown 209, the crown 209 is depressed. With this operation, the initialization is completed.

A calendar day call setting mode which is a characteristic feature of the present invention will be described below. As an example, an operation will be described, in which the day (Sunday) of Dec. 31, 2028 is called from a state of a current calendar date shown in FIG. 7, i.e., Friday, Oct. 7, 1977.

As described above, when the crown 209 is pulled to the first level to set the day call mode (serving also as a calendar correction mode), a switch $R_1$ is closed, and a switch ON signal $P_{R1}$ therefrom is held at H level. As a result, AND gates 31, 53, 73, and 93 of the respective control signal generating means 20, 50, 70, and 90 are held in an ON state.

In this state, the user operates a push button 212 while watching the display of the year hand 204 of the year indicator **204*b* so as to set the year hand 204** on the position of the year 2028 by the shortest angular interval (about 5/6 rotation).

In this case, as described above, no consideration is required as to a correspondence between a specific one of the spiral scales and the position indicated by the year hand 204.

This is because all the years 1916, 1944, 1972, 2000, 2028, 2056, and 2084 on the spiral scales indicated by the year hand 204 have the same calendar, as described above.

Subsequently, the user operates the push button 211 while watching the month hand 205 of a month indicator **205*a* so as to set the month hand 205** to December.

In addition, the user operates the push button 210 while watching the date hand 206 of a date indicator **206*a* so as to set the date hand 206 to the 31st day. A series of circuit operations in FIG. 5 are the same as those in FIG. 2**, and a detailed description thereof will be omitted.

When the date, month, and year hands are set to a desired date upon depression of the push buttons 210 to 212 in the above-described manner, the data of the counters 281, 61, and 41 are respectively changed and input to the Y, M, and D terminals of the day calculator 305. Subsequently, the day calculator 305 performs a day calculating operation. The output data from the $Q_1$ to $Q_3$ output terminals are also changed in accordance with the calculation value. As a result, the coincidence condition of the coincidence circuit 306 is dissatisfied, and an output signal from the Q terminal is held at L level so as to cancel the reset state of the output inhibiting circuit 301.

The date designating operation of the day call mode is performed in the above-described manner. When the crown is depressed to the zero level after this operation is completed, a day call operation is started. More specifically, when the switch $R_1$ shown in FIG. 5 is opened upon depression of the crown 209, the switch ON signal $P_{R1}$ is changed to L level so as to cancel the day call setting mode (correction mode). At the same time, an output signal $P_{12a}$ from the inverter **12*a* is set at H level. When the output signal $P_{12a}$ is supplied to a clock terminal CL of the output inhibiting circuit 301, the circuit 301 is set, and the day advance signal generator 303 connected to an output terminal Q of the circuit 301** is set in an operative state.

When a day advance signal output from the day advance signal generator 303 is supplied to the day hand driver 104 and the base-7 counter 307 through the OR gate 304, a day gear train/hand 106 is quickly advanced through a motor 105, and at the same time, the base-7 counter 307 is incremented.

If count data from the base-7 counter 307 coincides with the calculation value from the day calculator 305 which was changed upon day call setting, a coincidence signal is output from the output terminal Q of the coincidence circuit 306 so as to reset the output inhibiting circuit 301 again. As a result, the day advance signal generator 303 is restored to an inoperative state, and the day call operation is completed.

Consequently, the day hand 208 of a day indicator **208*a* shown in FIG. 4 indicates Sunday (SUN) corresponding to the date Dec. 31, 2028 designated by the year, month, and date hands 204, 205, and 206**.

The day call mode which is a characteristic feature of the present invention has been described above. At the time when this call mode is performed, the crown 209 is depressed to the zeroth level, and hence the normal calendar time mode is set. After the day of the desired year, month, and date is called and confirmed, the calendar display apparatus is restored to the current date in the following manner. The crown 209 is pulled to the first level to set the correction mode (serving also as the day call setting mode). Similar to the designating operation of the day call mode, the push buttons 210 to 212 are operated to set the current year, month, and date (Oct. 7, 1977). Thereafter, the crown 209 is depressed to the zeroth level to perform the above-described day call operation. As a result, the day hand 208 is quickly advanced to Friday, and the calendar display apparatus is restored to the current date.

Similar to the conventional apparatus shown in FIG. 2, until the crown 209 is pulled again, the normal calendar time display mode is set, in which the signal $P_{S24}$ is output from the date switch $S_{24}$ at midnight so as to cause each of the date advance signal generator 29 and the day advance signal generator 94 to generate one pulse, thus advancing the date and day hands 206 and 208 by an amount corresponding to one day.

That is, in this embodiment, the day call mode serving also as the conventional calendar correction mode is performed without any specific circuit arrangement for the day call mode. Therefore, a day of a desired date is retrieved by a day call operation, and a current day is restored by a current day call operation.

Figure 7A:
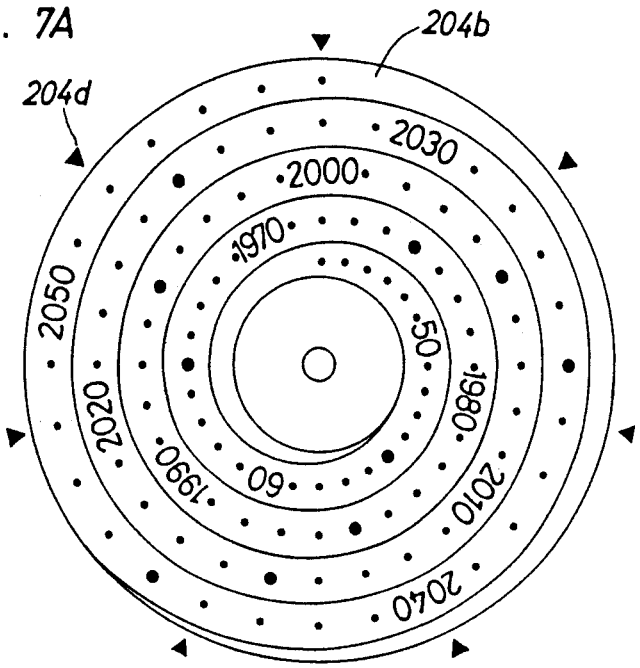
FIGS. 7A and 7B are front views each showing a modification of a year display portion of the present invention.
Figure 7B:
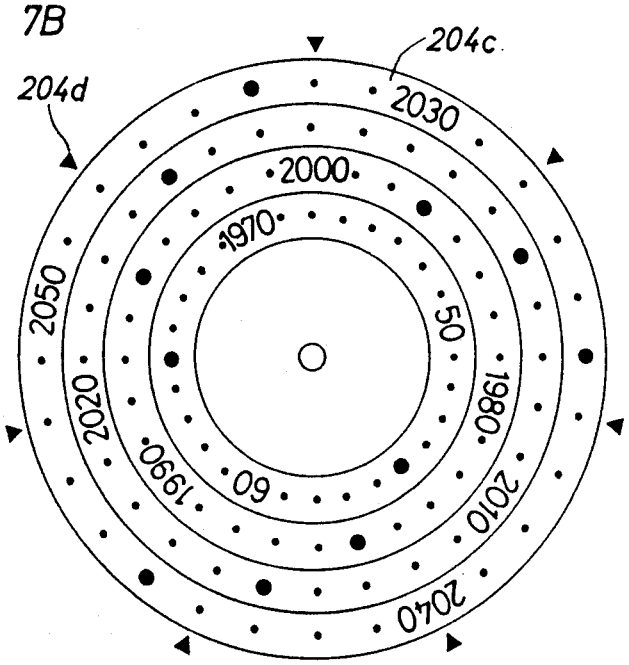

FIGS. 7A and 7B are enlarged front views respectively showing modifications of the year indicator having a cycle of 28 years shown in FIG. 4. FIG. 7A shows a spiral year indicator **204*b* which has been described in the embodiment. FIG. 7B shows a concentric year indicator 204*c*** according to another embodiment.

Both the year indicators **204*b* and 204*c* are designed such that year numbers (A.D.) are printed every 10 years on the multiple circles from the inner circumference to the outer circumferences, black dots are printed halfway between the year numbers, i.e., every five years, and leap year marks 204*d*** are printed around the outermost circumference every four years.

As is apparent from FIGS. 7A and 7B, the spiral year indicator **204*b* is superior, in continuity of the scale marks, to the concentric year indicator 204*c*, considering that the year indicator 204*b*** is constituted by multiple circular scales.

Figure 8:
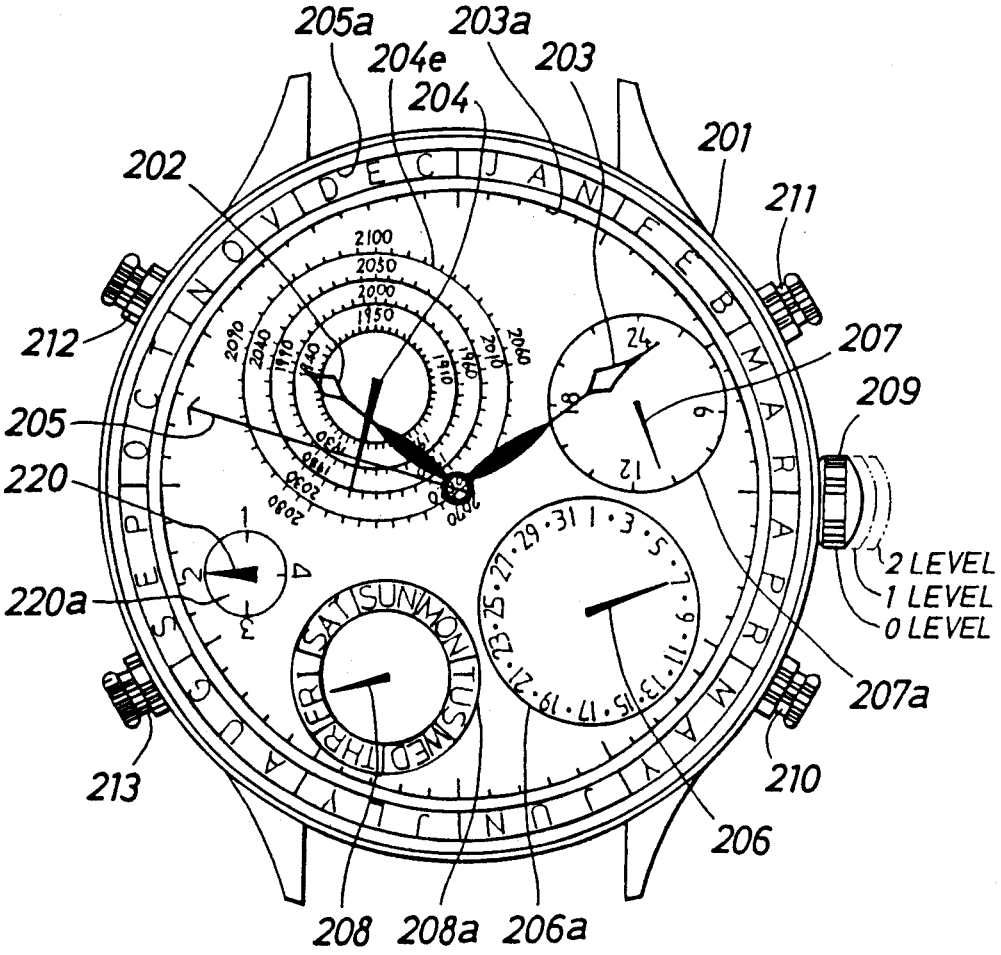
FIG. 8 is a front view showing an electronic timepiece having a calendar display apparatus according to another embodiment of the present invention.

FIG. 8 is a front view showing an outer appearance of an electronic timepiece having a calendar display apparatus according to another embodiment of the present invention. The same reference numerals in FIG. 8 denote the same parts as in FIG. 4, and a description thereof will be omitted. The apparatus of this embodiment is different from the one in FIG. 4 in that the scale marks on one circumference of a year indicator **204*e*** do not correspond to $28 \times n$ years but correspond to 50 years, and four-multiple circular scales display marks corresponding to 200 years.

As described above in the preceding embodiment, if the number of scale marks on one circumference is set to be a value other than $28 \times n$, a plurality of year numbers on the multiple circular scales which are simultaneously indicated by one year hand 104 do not have the same calendar. Therefore, a user must know a correspondence between one of the multiple circular scales and a year number currently indicated by the year hand 204. For this purpose, this embodiment comprises a turn indicator 220a for displaying a year number on a specific circular scale by using a turn hand 220. More specifically, turn scale marks "1" to "4" corresponding to the four-multiple circular scales of the year indicator 204d are formed on the turn indicator 220a so as to identify a year number of the year indicator 204e corresponding to one of the turn scale marks indicated by the turn hand 220.

In FIG. 8, the year hand 204 indicates four year numbers, i.e., 1927, 1977, 2027, and 2077 on the four-multiple circular scales, and the turn hand 220 indicates the turn scale mark "2" of the turn indicator 220a. Therefore, the year number 204 indicates the year number on the second turn, i.e., the year 1977.

If a turn display member corresponding to the year indicator 204e is arranged as in the embodiment shown in FIG. 8, the year numbers on the multiple circular scales can be directly indicated. Therefore, no consideration is required for the conditions of special years as in the embodiment in FIG. 4, and a year number display of more than 200 years can be performed. That is, in this embodiment, a year display can be performed to the limit of the number of scale marks which can be printed in the space of the year indicator 204e.

As is apparent from the above description, according to the present invention, the scale for calendar year display is constituted by multiple circular scale marks, and scale marks representing years are sequentially formed on the multiple circular scales from the inner circumference to the outer circumferences. Therefore, the scale range can be extended within the limited space of the year indicator, and a year display of 200 years or more can be realized. In addition, since the multiple circular scales are formed into a spiral shape, a sense of continuity of the scale marks can be ensured. Furthermore, with a combination of the multiple circular scales of the year indicator and the turn indicating means, a year display of many years can be realized.

In order to realize a calendar of a day call system, the scale marks on one circumference of the multiple circular scales are set to correspond to $(28\times n)$ years, and a base-28 counter is used as a year counter. With this arrangement, all the year numbers on the multiple circular scales indicated by one year hand can be included in identical calendars, and designation of a year in a day call operation can be performed through the shortest course.

As has been described above, according to the present invention, a year number display of many years can be performed within a small space such as a dial of a watch, and the years indicated by one year hand have the same calendar, thereby providing an electronic timepiece with a hand display system calendar which is excellent in performance and design.

What we claim is:

1. A calendar display apparatus including reference signal generating means for generating a reference signal having a period of 24 hours, calendar data generating means for generating year, month, date, and day data on the basis of the reference signal, and rotational display members, driven by signals from said calendar data generating means, for displaying a year, a month, a date, and a day, characterized in that a scale pointed by said rotational year display member comprises a multiple circular scale having year scale marks formed thereon continuously from an inner circumference to outer circumferences thereof such that number of years increases sequentially.

2. An apparatus according to claim 1, wherein said multiple circular scale is a concentric circle scale.

3. An apparatus according to claim 1, wherein said multiple circular scale is formed in a spiral shape.

4. An apparatus according to claim 1, further comprising a turn display means for displaying the number of turns of said rotational year display member on said multiple circular scale.

5. An apparatus according to claim 1, wherein scale marks on said multiple circular scale indicate $(28\times n)$ years (n is a positive integer) per revolution of said rotational year display member.

6. An apparatus according to claim 5, wherein scale marks on said multiple circular scale indicate 28 year per revolution of said rotational year display member.

7. An apparatus according to claim 5, wherein said year data generating means comprises a base-$(28\times n)$ counter (n is a positive integer).

8. An apparatus according to claim 7, wherein said year data generating means comprises a base-$(28\times n)$ counter (n is a positive integer), said rotational year display member has a drive range of $(28\times n)$ years (n is a positive integer), said apparatus further comprises a day call circuit including a base-7 counter corresponding to days of a week, a day calculator for calculating a day on the basis of month and date data from said calendar data generating means and data of a base-28 counter of said year data generating means, and a day advance signal generator controlled by a calculation value from said day calculator, and wherein said rotational day display member is driven by a day advance signal output from said day call circuit while said base-7 counter is quickly advanced.

9. An apparatus according to claim 8, wherein said day call circuit comprises a coincidence circuit for detecting a coincidence between a calculation value from said day calculator and a count of said base-7 counter to control generating operation of a day advance signal by said day advance signal generator in response to an output from said coincidence circuit.

10. An apparatus according to claim 1, wherein year numbers (A.D.) are indicated on each circumference of said multiple circular scale at intervals of 10 years.

11. An apparatus according to claim 1, wherein leap year marks are indicated around an outermost circumference of said multiple circular scale at intervals of four years.

* * * * *